US008789554B1

(12) United States Patent
Oas

(10) Patent No.: US 8,789,554 B1
(45) Date of Patent: Jul. 29, 2014

(54) RAINWATER COLLECTION/DISTRIBUTION SYSTEM

(75) Inventor: Stephen M Oas, Erie, PA (US)

(73) Assignee: Emsco, Inc., Girard, PA (US)

( * ) Notice: Subject to any disclaimer, the term of this patent is extended or adjusted under 35 U.S.C. 154(b) by 979 days.

(21) Appl. No.: 12/383,657

(22) Filed: Mar. 27, 2009

(51) Int. Cl.
*E03B 3/02* (2006.01)

(52) U.S. Cl.
USPC ..... 137/357; 137/360

(58) Field of Classification Search
USPC ..... 137/357, 360; 239/63, 282; 285/148.22, 285/148.23; 52/16
See application file for complete search history.

(56) References Cited

U.S. PATENT DOCUMENTS

| | | | | |
|---|---|---|---|---|
| 4,182,376 | A * | 1/1980 | Nilsson | 137/874 |
| 4,693,419 | A * | 9/1987 | Weintraub et al. | 239/63 |
| 5,114,594 | A * | 5/1992 | Rosebrock et al. | 210/767 |
| 5,533,303 | A * | 7/1996 | Harvey | 52/16 |
| 5,863,151 | A * | 1/1999 | Chapotelle | 405/52 |
| 2010/0193046 | A1 * | 8/2010 | Moroder et al. | 137/357 |

FOREIGN PATENT DOCUMENTS

GB 2249338 A * 5/1992

* cited by examiner

*Primary Examiner* — Jason Boeckmann
(74) *Attorney, Agent, or Firm* — Richard K Thomson

(57) ABSTRACT

An adaptor accommodates both of the most predominant sizes of downspouts and, when positioned between an upper and lower section, diverts rainwater through an opening in a sidewall to a collection system such as one or more rain barrels. Preferably, the collection system is attached to a soaker hose which provides on-demand irrigation of a treated plot of soil. A central passageway accommodates rainwater which exceeds the capacity of the collection system.

7 Claims, 4 Drawing Sheets

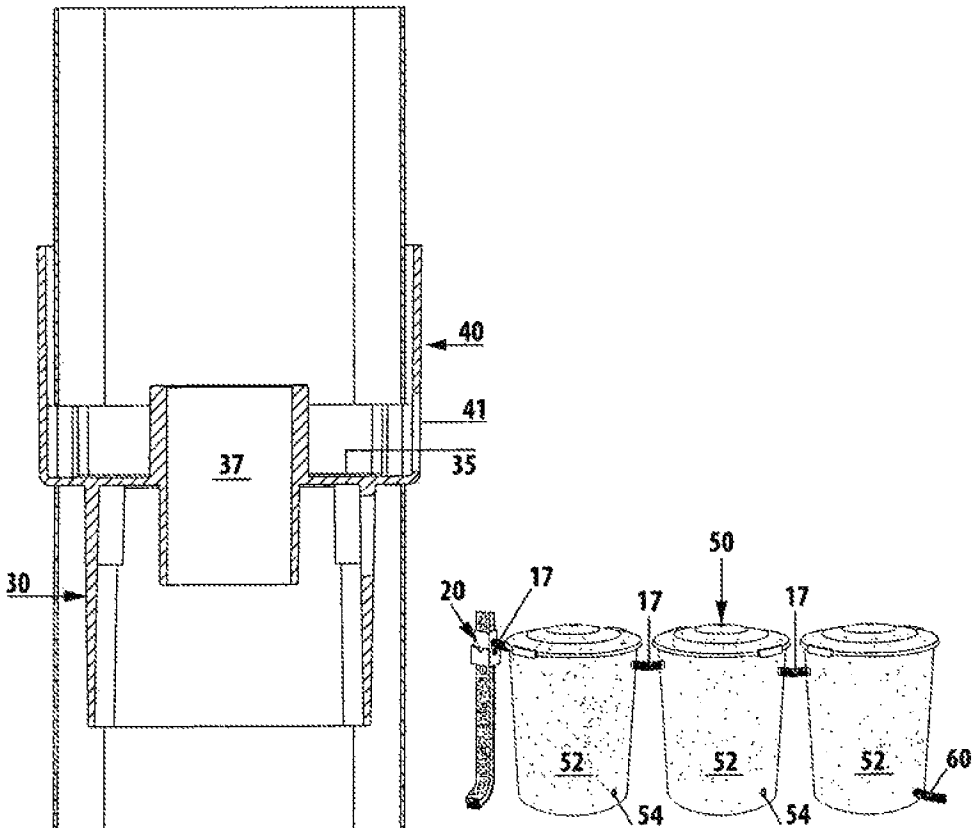
Fig. 5
Fig. 4B
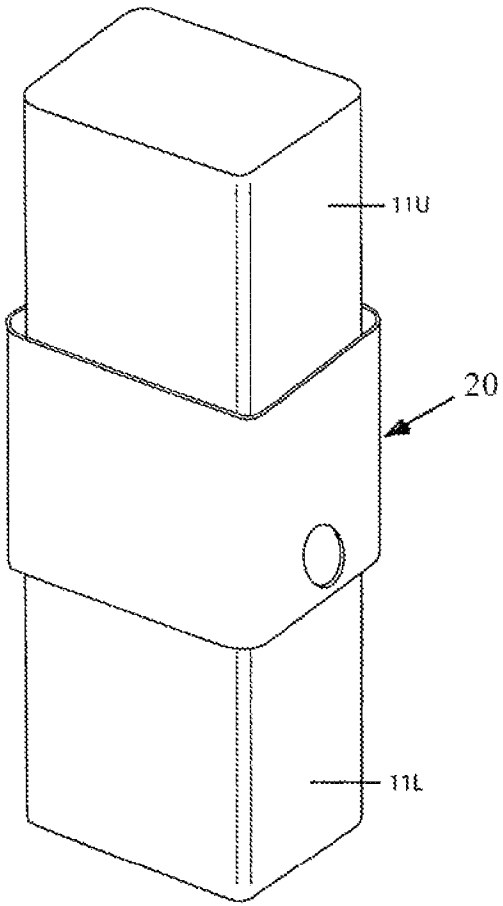
Fig. 4A

RAINWATER COLLECTION/DISTRIBUTION SYSTEM

BACKGROUND AND SUMMARY OF THE INVENTION

The present invention is directed to the field of agriculture. More particularly, the present invention is directed to a system for collecting and distributing rainwater to a section of soil.

The advantages of using rainwater in gardening have long been appreciated. There seemingly is no substitute for the refreshing which rainwater brings to plants. Accordingly, there has been an increased interest in collecting and distributing rainwater to plants and any number of systems have been developed to achieve that end.

It is an object of the present invention to provide a collection system which is versatile, being capable of use with either of the two down spout sizes predominant in the United States; the adaptor can deliver rainwater to any type of collection device desired, providing a variety of suitable rain barrels to meet most any need, and delivering a supply of rainwater to a suitable distribution system such as an on-demand soaker hose.

The present invention includes an adaptor for installation between sections of a downspout for diverting rainwater to a rain barrel, the adaptor having a) a first section with a first peripheral dimension capable of receiving a first standard-size downspout; b) a second section having a second peripheral dimension greater than the first peripheral dimension capable of receiving a second standard-size downspout; c) membrane means positioned between the first section and the second section interconnecting the first and second sections, the membrane means further capturing and diverting rainwater clinging to sides portions of the downspout; d) collector means for receiving the rainwater from the membrane means. The collector means preferably comprises e) a first hole in a sidewall of the first section attachable to a conduit; f) a second hole in a sidewall of the second section attachable to a conduit; g) a conduit attachable to either the first or second hole to receive and convey the rainwater to the rain barrel. The adaptor includes a central passageway formed in the membrane means permitting rainwater exceeding the capacity of the collector means to flow into a downstream section of downspout.

Another aspect of the invention includes a rainwater collection system having a) a rain barrel; b) an adaptor including I) a first section having a first peripheral dimension capable of receiving a first standard size downspout; ii) a second section having a second peripheral dimension greater than the first peripheral dimension capable of receiving a second standard size downspout; iii) membrane means positioned between the first section and the second section interconnecting the first and second sections, the membrane means further capturing and diverting rainwater clinging to sides portions of the downspout; iv) collector means for receiving the rainwater from the membrane means and transferring the rainwater to the rain barrel. The rainwater collection system includes v) a first hole in a sidewall of the first section attachable to a conduit; vi) a second hole in a sidewall of the second section attachable to a conduit; vii) a conduit attachable to either the first or second hole to receive and convey the rainwater to the rain barrel. As with the earlier aspect of the invention, a central passageway is formed in the membrane means permitting rainwater exceeding a capacity of the collector means to flow into a downstream section of downspout.

Still a further aspect of the invention involves a rainwater capturing and distribution system including a) an adaptor featuring: I) a first section having a first peripheral dimension capable of receiving a first standard size downspout; ii) a second section having a second peripheral dimension greater than the first peripheral dimension capable of receiving a second standard size downspout; iii) membrane means positioned between the first section and the second section interconnecting the first and second sections, the membrane means further capturing and diverting rainwater clinging to sides portions of the downspout; iv) collector means for receiving the rainwater from the membrane means; b) a rain barrel for receiving rainwater from the collector means; c) distributing means for transferring the rainwater from the rain barrel to a section of soil which is to be watered thereby. Preferably, the distributing means comprises a soaker hose attached to a bottom portion of the rain barrel. A valve means can be associated with the soaker hose, the valve means opening to distribute water responsive to a sensor embedded in the section of soil serviced by the system.

Valves operated by soil-embedded sensors for irrigation of plots of land are widely known. Examples of patents teaching such systems are U.S. Pat. Nos. 4,693,419 and 4,684,920 which are hereby incorporated by reference.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which

FIG. 4A is a perspective side view of the first embodiment of the adaptor of the present invention installed with a second size of downspout;

FIG. 4B is a cross-sectional side view of the first embodiment of the adaptor of the present invention installed with a second size of downspout;

FIG. 5 is a schematic depiction of the first embodiment of the adaptor of the present invention employed in a water collection and/or collection and distribution system.

DETAILED DESCRIPTION OF THE PREFERRED EMBODIMENT(S)

Figure 1:
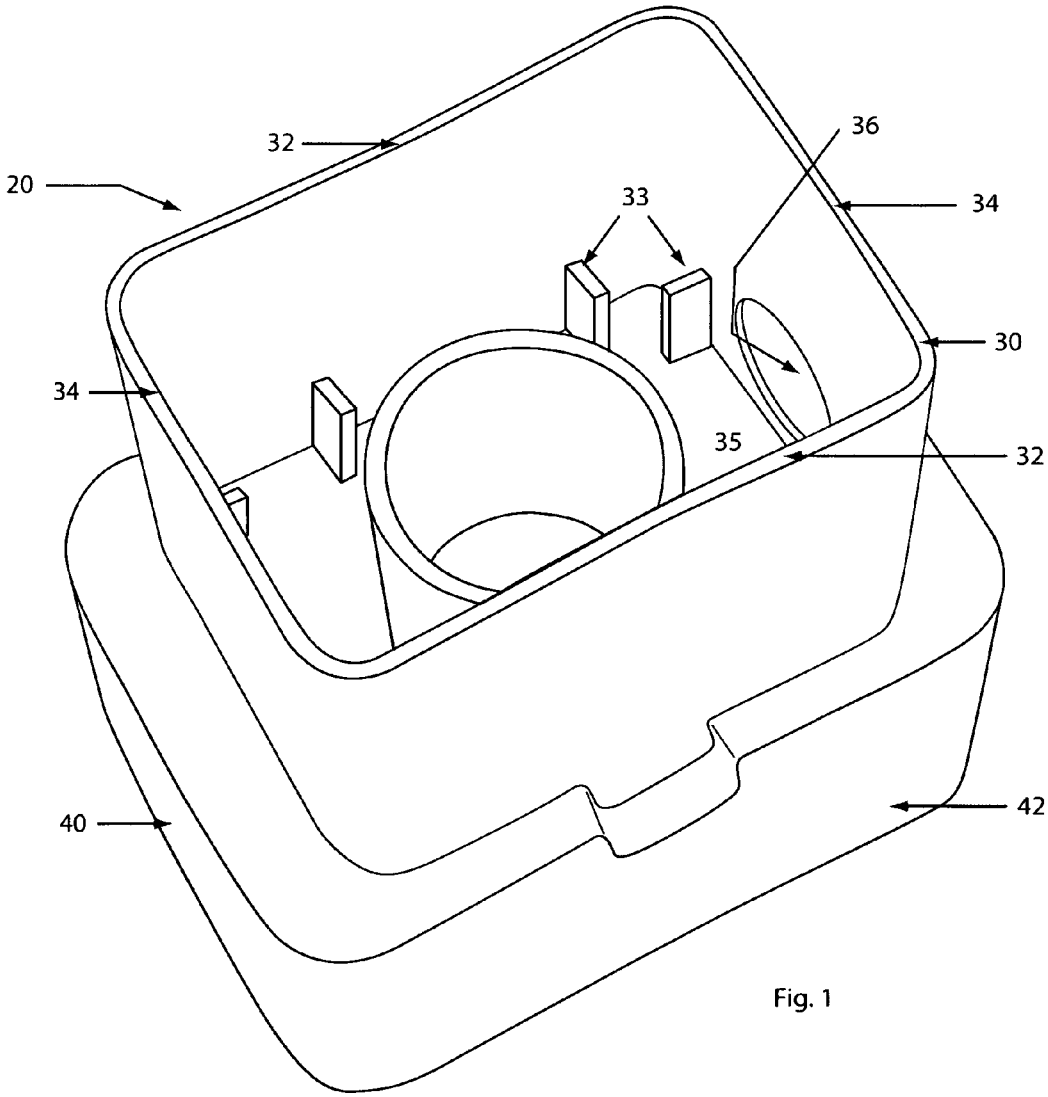
FIG. 1 is a perspective top view of a first embodiment of the adaptor of the present invention.
Figure 2:
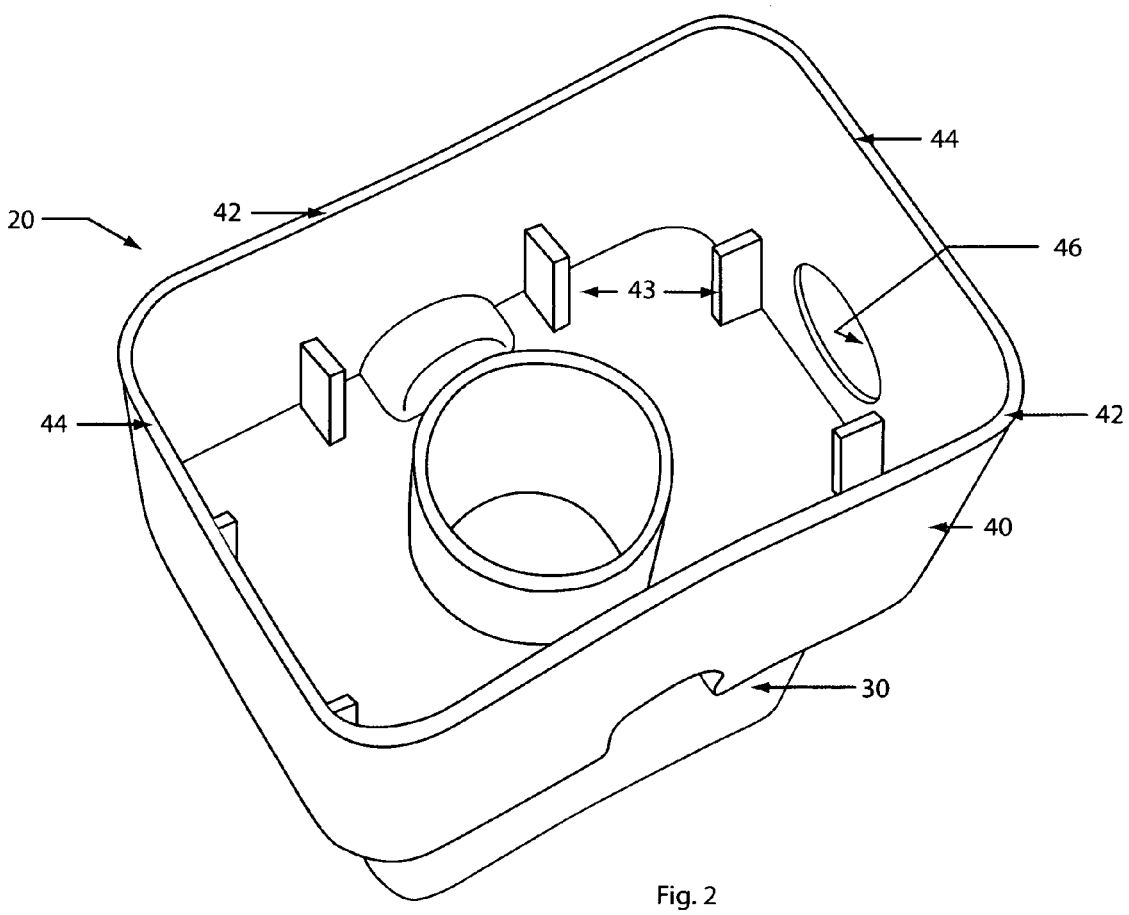
FIG. 2 is a perspective bottom view of the first embodiment.
Figure 3A:
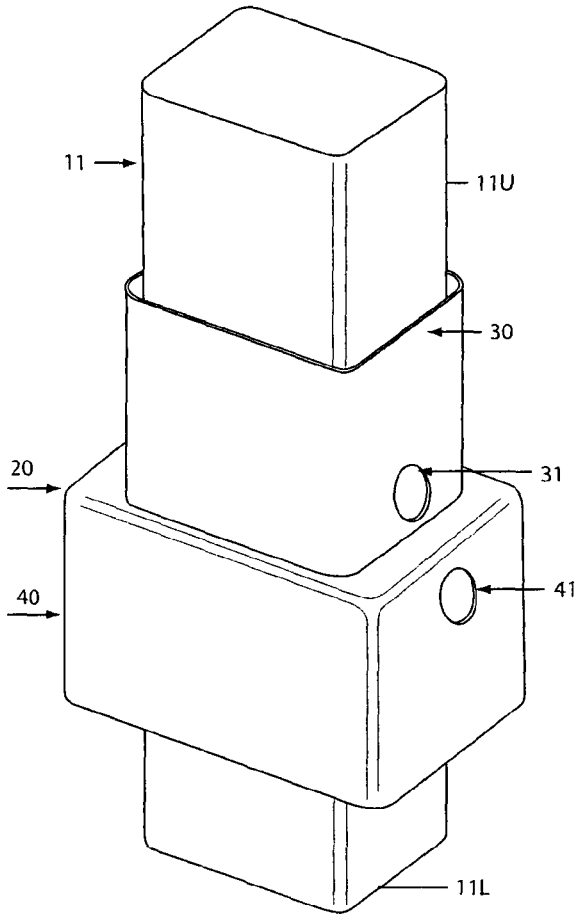
FIG. 3A is a perspective side view of the first embodiment of the adaptor of the present invention installed with a first size of downspout.
Figure 3B:
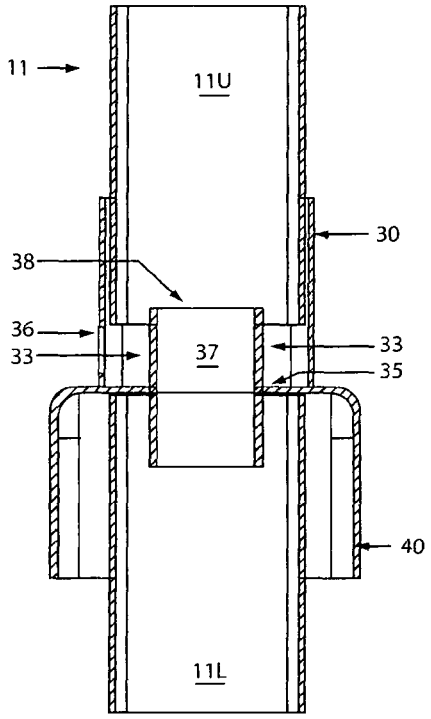
FIG. 3B is a cross-sectional side view of the first embodiment of the adaptor of the present invention installed with a first size of downspout.

A first embodiment of the adaptor used with the collection/distribution system is depicted in FIGS. 1-4 generally at 20. Adaptor 20 is inserted between upper downspout section 11U and lower downspout section 11L and includes a first section 30 having a first peripheral dimension, defined by side walls 32 and end walls 34, capable of receiving a first standard-size (2"×3") downspout 11 (FIG. 3A, 3B). The leading edge of upper downspout section 11U engages standoffs 33 so that hole 36 (or 46) of collector means is not blocked. Second section 40 has a second peripheral dimension, defined by side walls 42 and end walls 44, greater than the first peripheral dimension, capable of receiving a second standard-size (3"× 4") downspout 13 (FIGS. 4A and 4B). Membrane means 35 is positioned between first section 30 and second section 40 interconnecting those sections. Membrane means 35 captures and diverts rainwater clinging to sides portions of upper downspout section 11U, in this first configuration, and of downspout section 13U when inverted to form the second configuration depicted in FIGS. 4A and 4B. Collector means includes a first hole 36 through end wall 34 formed by pushing out knockout 31, and a second hole 46 which can be formed in end wall 44 by removing knockout 41. One of these holes 36, 46 will capture and divert rainwater received by membrane means 35. Preferably, the collector means includes a conduit such as a tube, pipe, or a section of hose 17. In either configuration, lower downspout section 11L fits snugly against membrane 35, either because smaller dimensioned downspout 11L fits inside the standoffs 43 (FIG. 3B), or because the smaller dimensioned section 30 fits inside larger dimensioned downspout 11L (FIG. 4B).

In addition to providing an adaptor 20 for use with a downspout to divert rainwater, the present invention contemplates providing a collection system 50 which may include one or more rain barrels 52 (FIG. 5). As depicted in FIG. 5, a plurality of barrels interconnected by short sections of conduit 17' may provide a more extensive collection system. Each of the barrels 52 can be provided with a knockout 54 to permit attachment of a soaker hose 60. As an alternative to a conventional rain barrel, the assignee of the present invention could provide a collection vessel that appears to be a decorative stone, sold under the trademark "Water Stones" which may be used individually or connected in series as depicted in FIG. 5. It is preferred that a valve (not shown) will control the supply of rainwater from the collection system responsive to a soil-embedded sensor in the manner taught by U.S. Pat. Nos. 4,693,419 and 4,684,920. Should the rainwater provided by the adaptor 20 exceed the capacity of the collection system 50, rainwater will backup in conduit 17 and spill over the edge of cylindrical sleeve 38 surrounding and defining central passageway 37, which extends through membrane 35, the rainwater continuing into lower downspout section 11L. This collection/distribution system provides a foolproof irrigation system which requires no, to low, user attention and maintenance.

While the collection/distribution system depicted here shows rainwater being used for gardening applications, some European uses include distributing the water to a cistern where it can be filtered for other household uses including laundry, bathing and other restroom applications. Should the filtering technology advance sufficiently, the collected rainwater may one day be converted for potable usage.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. An adaptor for installation between sections of a downspout for diverting rainwater to a rain barrel, said adaptor being usable with two different sizes of downspouts and comprising:

a) a first section on a first end having a first longitudinal center axis and a first peripheral dimension capable of receiving a first standard-size downspout;

b) a second section on a second opposite integrally formed end having a second longitudinal center axis coaxial with said first longitudinal center axis and a second peripheral dimension greater than said first peripheral dimension capable of receiving a second standard-size downspout by inverting said adaptor and inserting said first section inside said downstream end of said second standard-sized downspout;

c) membrane means positioned between said first section and said second section interconnecting said first and second sections, said membrane means further capturing and diverting rainwater clinging to sides portions of the downspout;

d) collector means for receiving the rainwater from said membrane means;

e) a first hole in an outermost sidewall of said first section attachable to a conduit;

f) a second hole in an outermost sidewall of said second section attachable to a conduit immediately below said first hole, each of said first and second holes being adapted for connection to a conduit attachable to either of said holes to receive and convey the rainwater to the rain barrel;

g) a short cylindrical sleeve having a third longitudinal center axis coaxial with each of said first and second longitudinal center axes, said sleeve extending from a point just above said first hole to a point just below said second hole.

2. The adaptor of claim 1 wherein said short cylindrical sleeve surrounds and further comprises a central passageway formed in said membrane means permitting rainwater exceeding a capacity of said collector means to flow into a downstream section of the downspout.

3. The rainwater collection system of claim 1 wherein said short cylindrical sleeve of said adaptor surrounds and further comprises a central passageway formed in said membrane means permitting rainwater exceeding a capacity of said collector means to flow into a downstream section of downspout.

4. A rainwater collection system including:

a) a rain barrel;

b) an adaptor including:

i) a first section on a first end having a first longitudinal center axis and a first peripheral dimension capable of receiving a first standard size downspout;

ii) a second section on a second opposite integrally formed end having a second peripheral dimension greater than said first peripheral dimension capable of receiving a second longitudinal center axis coaxial with said first longitudinal center axis and a second standard size downspout by inverting said adaptor and inserting said first section inside said said second standard-sized downspout;

iii) membrane means positioned between said first section and said second section interconnecting said first and second sections, said membrane means further capturing and diverting rainwater clinging to sides portions of the downspout;

iv) collector means for receiving the rainwater from said membrane means and transferring the rainwater to said rain barrel;

v) a first hole in an outermost sidewall of said first section attachable to a conduit;

vi) a second hole in an outermost sidewall of said second section attachable to a conduit;

vii) a conduit attachable to either said first or second hole to receive and convey the rainwater to said rain barrel;

viii) a short cylindrical sleeve having a third longitudinal center axis coaxial with each of said first and second longitudinal center axes, said sleeve extending from a point just above said first hole to a point just below said second hole.

5. A rainwater capturing and distribution system comprising:

a) an adaptor usable with two different sizes of downspouts and including:

I) a first section on a first end having a first longitudinal center axis and a first peripheral dimension capable of receiving a first standard size downspout;

ii) a second section on a second opposite integrally formed end having a second longitudinal center axis coaxial with said first longitudinal center axis and a second peripheral dimension greater than said first peripheral dimension capable of receiving a second standard size downspout by inverting said adaptor and inserting said first section inside said downstream end of said second standard-sized downspout;

iii) membrane means positioned between said first section and said second section interconnecting said first and second sections, said membrane means further capturing and diverting rainwater clinging to sides portions of the downspout;

iv) a first hole in an outermost sidewall of said first section attachable to a conduit;

v) a second hole in an outermost sidewall of said second section attachable to a conduit;

vi) a conduit attachable to either said first or second hole to receive and convey the rainwater to said rain barrel, said conduit serving as collector means;

vii) a short cylindrical sleeve having a third longitudinal center axis coaxial with each of said first and second longitudinal center axes, said sleeve extending from a point just above said first hole to a point just below said second hole;

b) a rain barrel for receiving rainwater from said collector means;

c) distributing means for transferring the rainwater from said rain barrel to a section of soil which is to be watered thereby.

6. The rainwater capturing and distribution system of claim 5 wherein said distributing means comprises a soaker hose attached to a bottom portion of said rain barrel.

7. The rainwater capturing and distribution system of claim 6 further comprising valve means associated with said soaker hose, said valve means opening to distribute water responsive to a sensor embedded in the section of soil serviced by said system.

* * * * *